US009482996B1

(12) United States Patent
Ono

(10) Patent No.: US 9,482,996 B1
(45) Date of Patent: Nov. 1, 2016

(54) TRANSFER ROLLER, PROCESS CARTRIDGE, AND IMAGE FORMING APPARATUS

(71) Applicant: FUJI XEROX CO., LTD., Tokyo (JP)

(72) Inventor: Masato Ono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/044,459

(22) Filed: Feb. 16, 2016

(30) Foreign Application Priority Data

Aug. 14, 2015 (JP) ..... 2015-160101

(51) Int. Cl.
*G03G 15/20* (2006.01)
*G03G 15/16* (2006.01)

(52) U.S. Cl.
CPC ..... *G03G 15/1685* (2013.01)

(58) Field of Classification Search
CPC ..... G03G 15/1685
USPC ..... 399/313
See application file for complete search history.

(56) References Cited

U.S. PATENT DOCUMENTS

2008/0057289 A1* 3/2008 Ichikawa ..... B32B 5/18 428/304.4
2012/0322637 A1* 12/2012 Takano ..... C08J 9/0066 492/56

FOREIGN PATENT DOCUMENTS

JP 2010-164821 A 7/2010

* cited by examiner

*Primary Examiner* — Hoang Ngo
(74) *Attorney, Agent, or Firm* — Oliff PLC

(57) ABSTRACT

A transfer roller includes a support, a foamed elastic layer disposed on the outer peripheral surface of the support, and a surface resin layer that covers the outer peripheral surface of the foamed elastic layer and contains polyimide or polyamide-imide. Bubbles contained in a central portion in the roller axial direction have a shape crushed in the thickness direction of the foamed elastic layer as compared with bubbles at both ends in the roller axial direction.

4 Claims, 4 Drawing Sheets

TRANSFER ROLLER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-160101 filed Aug. 14, 2015.

BACKGROUND (i) Technical Field

The present invention relates to a transfer roller, a process cartridge, and an image forming apparatus.

(ii) Related Art

In an image forming apparatus using an electrophotographic system, charge is formed on the surface of an image holding member such as a photoconductor or the like by using a charging device, and an electrostatic latent image is formed by a laser beam modulated based on an image signal and is then developed with a charged toner to form a visualized toner image which is then transferred to a recording medium directly or through an intermediate transfer body.

For example, in the case of an intermediate transfer system, a toner image formed on the surface of an image holding member is electrostatically first transferred to the surface (outer peripheral surface) of an intermediate transfer belt, then electrostatically second transferred to a recording medium such as recording paper or the like, and fixed to the recording medium by heating and pressing in a fixing device.

Various conductive rollers are developed as a transfer roller that transfers a toner image on an image holding member to the recording medium or to the intermediate transfer belt, or a transfer roller that transfers the toner image on the intermediate transfer belt to the recording medium.

SUMMARY

According to an aspect of the invention, there is provided a transfer roller including a support, a foamed elastic layer disposed on the outer peripheral surface of the support, and a surface resin layer that covers the outer peripheral surface of the foamed elastic layer and contains polyimide or polyamide-imide. Bubbles contained in a central portion of the foamed elastic layer in the roller axial direction have a shape crushed in the thickness direction of the foamed elastic layer as compared with bubbles at both ends in the roller axial direction.

BRIEF DESCRIPTION OF THE DRAWINGS

Exemplary embodiments of the present invention will be described in detail based on the figures, wherein.

DETAILED DESCRIPTION

Figure 1:
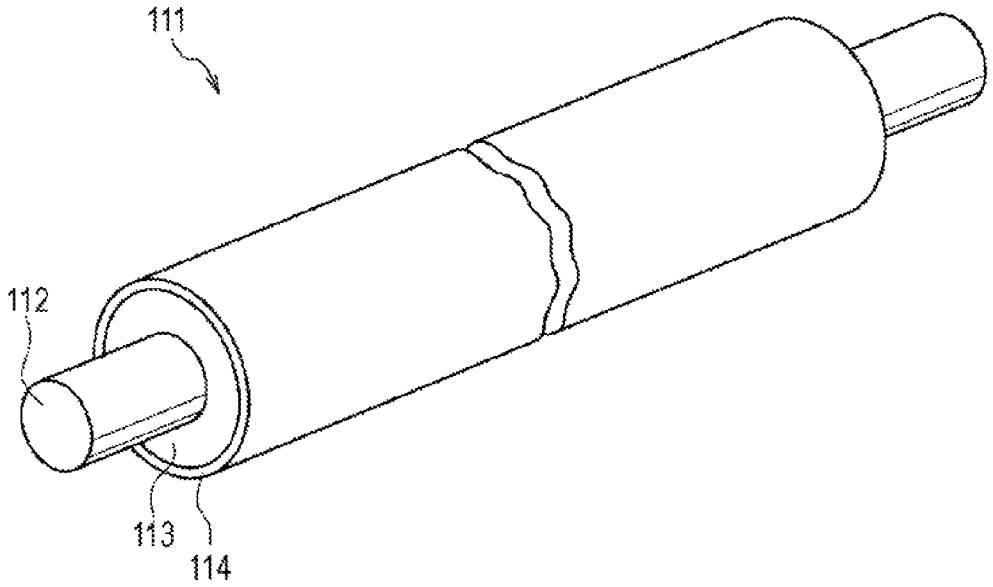
FIG. 1 is a schematic perspective view showing an example of a transfer roller according an exemplary embodiment of the present invention.

An exemplary embodiment of the present invention is described below with reference to the drawings. Members having a common function are denoted by the same reference numeral in all drawings, and duplicated description may be eliminated.

<Transfer Roller>

A transfer roller according to an exemplary embodiment of the present invention includes a support, a foamed elastic layer disposed on the outer peripheral surface of the support, and a surface resin layer that covers the outer peripheral surface of the foamed elastic layer and contains polyimide or polyamide-imide. Bubbles contained in a central portion of the foamed elastic layer in the roller axial direction have a shape crushed in the thickness direction of the foamed elastic layer as compared with bubbles at both ends in the roller axial direction.

Figure 2:
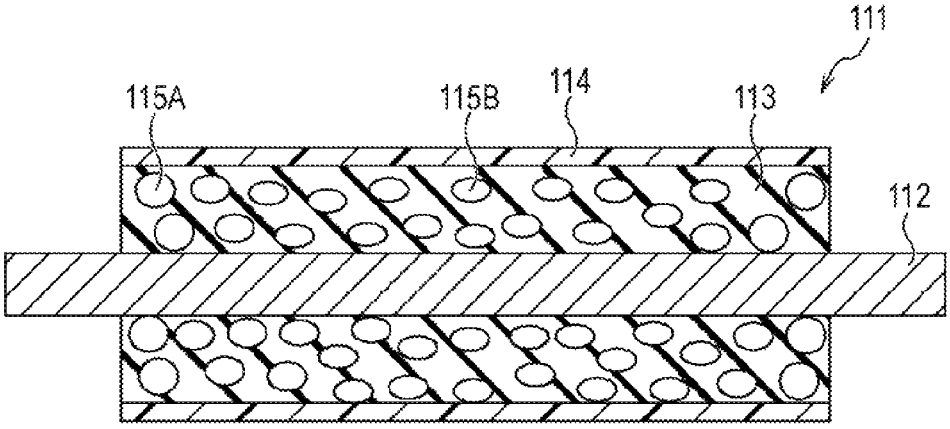
FIG. 2 is a drawing schematically showing a section in the axial direction of the transfer roller shown in FIG. 1.

FIG. 1 schematically shows in example of the transfer roller according the exemplary embodiment of the present invention. FIG. 2 schematically shows a section in the axial direction of the transfer roller according the exemplary embodiment. As shown in FIG. 1, a transfer roller 111 according to the exemplary embodiment of the present invention is a transfer member including, for example, a cylindrical or columnar support 112 (shaft), a foamed elastic layer 113 provided on the outer peripheral surface of the support 112, and a surface resin layer 114 provided on the outer peripheral surface of the foamed elastic layer 113.

As shown in FIG. 2, bubbles contained in the foamed elastic layer 113 of the transfer roller 111 according to the exemplary embodiment of the present invention include bubbles 115A at both ends in the roller axial direction and bubbles 115B in a central portion in the roller axial direction which have a shape crushed in the thickness direction of the foamed elastic layer 113 as compared with the bubbles 115A. The "shape crushed in the thickness direction of the foamed elastic layer" represents that the bubbles contained the foamed elastic layer have a relation $X<Y$ wherein X is the length in the thickness direction of the foamed elastic layer, and Y is the length in the roller axial direction, and that the smaller the value of X/Y is, the more crushed in the thickness direction of the foamed elastic layer the shape is.

The occurrence of transfer unevenness is suppressed by using the transfer roller 111 having the configuration described above according to the exemplary embodiment. The reason for this is supposed as described below.

A transfer roller used in an image forming apparatus in an electrophotographic system may cause a load distribution in the roller axial direction due to bending of a support (shaft) subjected to a load from an opposite member such as a roller disposed opposite to the transfer roller, an image holding member, or the like during nipping, thereby causing transfer unevenness in the roller axial direction or cleaning defect.

For example, in order to suppress re-transfer, to a recording medium, of a toner adhering to the outer peripheral surface of the transfer roller, cleaning performance is required for the transfer roller. An example of a method for improving the cleaning performance of the transfer roller is a method of coating the foamed elastic layer with a resin-made tubular member (resin tube). However, when the foamed elastic layer having a shape (straight shape) having the same outer diameter in the roller axial direction is coated with the resin tube, a nip load during transfer of the toner image to the recording medium is concentrated at the end parts. Thus, it is considered that a load distribution in the roller axial direction is increased, and uniformity of the transfer current is decreased, thereby causing transfer unevenness.

The uniformity of the nip load may be improved by, for example, processing the outer peripheral surface of the foamed elastic layer into a shape (crown shape) in which the outer diameter in a central portion is longer than that at the both ends in the roller axial direction. However, it is difficult to coat the crown-shaped foamed elastic layer with the crown-shaped resin tube.

Also, for example, when a crown-shaped transfer roller is used in a configuration in which a cleaning blade is disposed in contact with a second transfer roller in order to prevent toner adhesion, it is difficult to bring the cleaning blade into contact with the transfer roller over the entire region in the roller axial direction, and thus cleaning defect easily occurs.

On the other hand, the foamed elastic layer 113 of the transfer roller 111 according to the exemplary embodiment contains bubbles having a shape rushed in the thickness direction in a central portion as compared with bubbles positioned at both ends in the roller axial direction. Therefore, at both ends, the foamed elastic layer 113 is easily deformed and hardly subjected to a nip load, and conversely in the central portion, the foamed elastic layer 113 is hardly deformed and easily subjected to a nip load. Thus, the transfer roller 111 according to the exemplary embodiment has high uniformity in a nip load distribution in the roller axial direction. Therefore, the transfer roller 111 according to the exemplary embodiment has high uniformity of a transfer current in the axial direction and thus contributes to formation of a good image with suppressed density unevenness.

Further, the surface resin layer contains polyimide or polyamide-imide and is thus hardly deformed by repulsive force of the foamed elastic layer 113 and the foamed elastic layer may be compressed in the thickness direction. Also, the surface resin layer has high cleaning property and high cracking resistance, and is thus considered to stably contribute to formation of a good image even in long-term use.

The transfer roller according to the exemplary embodiment is described in further detail below.

(Support)

The support 112 is a member functioning as an electrode and a support member for the roller member.

The support 112 is a member made of a metal, for example, iron (free-cutting steel), copper, brass, stainless steel, aluminum,nickel, or the like.

Other examples of the support 112 include a member (for example, a resin or ceramic member) having a plated outer surface, a member (for example, a resin or ceramic member) in which a conductive agent is dispersed, and the like.

The support 112 may be a hollow member (cylindrical member) or a non-hollow member.

(Foamed Elastic Layer)

The foamed elastic layer 113 is disposed on the outer peripheral surface of the support 112 and contains bubbles having a shape crushed in the thickness direction of the foamed elastic layer 113 in the central portion as composed with bubbles at both ends in the roller axial direction.

In the exemplary embodiment, when the length of the foamed elastic layer 113 in the axial direction is 100%, the central portion in the axial direction of the foamed elastic layer 113 represents a portion having a width of 20% with a middle point between both ends (end surfaces) as a center, and both ends of the foamed elastic layer 113 represent portions having a width of 10% from the respective ends (end surfaces) to the central portion of the foamed elastic layer 113.

The shapes of the bubbles contained in the foamed elastic layer 113 may be compared by observing the shapes of cavities (portions configuring the bubbles 115) coming from the bubbles in a section taken in the thickness direction (radial direction) of the foamed elastic layer 113. Specifically, in a section of the transfer roller in the axial direction, the thickness-direction length X and the axial-direction length Y of each of 100 cavities present in the foamed elastic layer are measured by using a microscope, and X/Y is determined. Also, X/Y of each of 100 cavities present in the central portion or both ends in the axial direction is determined. Comparison between the average values of X/Y of the portions makes it possible to determine whether or not the bubbles in the central portion have a shape crushed in the thickness direction of the foamed elastic layer 113 as composed with the bubbles at both ends in the roller axial direction.

The foamed elastic layer 113 is made of, for example, a material containing a rubber material (elastic material) and a foaming agent, and if required, a conductive agent and other additives.

The rubber material (elastic material) is, for example, a so-called elastic material having at least a double bond in a chemical structure thereof.

Specific examples of the rubber material include isoprene rubber, chloroprene rubber, epichlorohydrin rubber (ECO), butyl rubber, polyurethane, silicone rubber, fluororubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene -propylene-diene ternary copolymer rubber (EPDM), acrylonitrile-butadiene copolymer rubber (NBR), natural rubber, and the like, and rubber mixtures thereof.

Among these rubber materials, polyurethane, ECD, EPDM, epichlorohydrin-ethylene oxide copolymer rubber, epichlorohydrin-ethylene oxide-allyl glycidyl ether copolymer rubber, NBR, and rubber mixtures thereof are preferred.

Examples of the foaming agent include benzene sulfonylhydrazide, azodicarbonamide (ADCA), N,N'-dinitrosopentamethylenetetramine, dinitrosopentamethylenetetramine (DPT), dinitrosopentastyrenetetramie, benzenesulfonylhydrazide derivatives, oxybisbenzenesulfonylhydrazide (OBSH), compounds which generate carbon dioxide such as ammonium bicarbonate, sodium bicarbonate, and ammonium carbonate, compounds which generate nitrogen such as nitrososulfonylazo compounds, N,N'-dimethyl-N,N'-dinitrosophthalamide, toluene sulfonylhydrazide, P-toluenesulfonyl semi-carbazide, P,P'-oxy-bis(benzenesulfonylsemi-carbazide), and the like.

Among these foaming agents, in view of the ease of foaming control, benzenesulfonylhydrazide and azodicarbonamide are preferred. These may be used alone or in combination of two or more.

The form of the foaming agent is not particularly limited and selected from a particle form, a liquid form, a capsule form, and the like according to purpose.

The conductive agent is used as needed, for example, when the rubber material has low conductivity or when the rubber material has no conductivity. Examples of the conductive agent include an electron conductive agent and an ion conductive agent.

Examples of the electron conductive agent include powders of: carbon black such as Ketjen black and acetylene black; pyrolytic carbon, and graphite; various conductive stainless steel; various conductive metal oxides such as tin oxide, indium oxide, titanium oxide, tin oxide-antimony oxide solid solution, tin oxide-indium oxide solid solution; insulating materials with surfaces subjected to conductive treatment; and the like.

Specific examples of the carbon black include "Special Black 350", "Special Black 100", "Special Black 250", "Special Black 5", "Special Black 4", "Special Black 4A", "Special Black 550", "Special Black 6", "Colour Black FW200", "Colour Black FW2", and "Colour Black FW2V" which are manufactured by Orion Engineered Carbons Co., Ltd., "MONARCH 1000", "MONARCH 1300", "MONARCH 1400", "MOGUL-L", and "REGAL 400R" which are manufactured by Cabot Corporation, and the like.

These electron conductive agents may be used alone or in combination of two or more.

The content of the electron conductive agent is, for example, 1 part by mass or more and 30 parts by mass or less and preferably 15 parts by mass or more and 25 parts by mass or less relative to 100 parts by mass of the rubber material.

Examples of the ion conductive agent include quaternary ammonium salts (for example, perchlorates, chlorates, tetrafluoroborates, sulfates, ethosulfates, and halogenated benzyl salts (for example, benzyl bromide salt, benzyl chloride salt, and the like) of, lauryltrimethyl ammonium, stearyltrimethyl ammonium, octadodecyltrimethyl ammonium, dodecyltrimethyl ammonium, hexadecyltrimethyl ammonium, modified fatty acid-dimethylethyl ammonium, or the like), aliphatic sulfonic acid salts, higher alcohol sulfuric acid ester salts, higher alcohol ethylene oxide-added sulfuric acid ester salts, higher alcohol phosphoric acid ester salts, higher alcohol ethylene oxide-added phosphoric acid ester salts, betaines, higher alcohol ethylene oxides, polyethylene glycol fatty acid esters, polyhydric alcohol fatty acid esters, and the like.

These ion conductive agents may be used alone or in combination of two or more.

The content of the ion conductive agent is, for example, in a range of 0.1 parts by mass or more and 5.0 parts by mass or less and preferably 0.5 parts by mass or more and 3.0 parts by mass or less relative to 100 parts by mass of the rubber material.

Examples of other additives include materials which may be generally added to an elastic layer, such as a foaming aid, a softening agent, a plasticizer, a curing agent, a vulcanizing agent, a vulcanization accelerator, an antioxidant, a surfactant, a coupling agent, a filler (silica, calcium carbonate, and the like), and the like.

From the viewpoint of image quality, the volume resistivity of the foamed elastic layer 113 is preferably 6 (LogΩ·cm) or more 8 (LogΩ·cm) or less and more preferably 6.5 (LogΩ·cm) or more 7.5 (LogΩ·cm) or less in terms of a common logarithm value. The volume resistivity of the foamed elastic layer 113 is adjusted by, for example, the type and amount of the conductive agent mixed.

The thickness of the foamed elastic layer 113 is, for example, 2 mm or more and 20 mm or less and preferably 2 mm or more and 15 mm or less. With the thickness of less than 2 mm, leakage may occur due to the thin thickness, while with the thickness of over 15 mm, breakage may occur due to excessive deformation in a vulcanization/foaming step during production.

(Surface Resin Layer)

The surface resin layer 114 is configured to cover the outer peripheral surface of the foamed elastic layer 113 and contain polyimide or polyamide-imide.

For example, when a PFA (tetrafluoroethylene perfluoroalkyl vinyl ether copolymer) tube is used as the surface resin layer 114, adhesion of the toner may be suppressed, and high cleaning performance may be achieved. However, when the foamed elastic layer 113 is coated with the PAF tube, the PFA tube is easily deformed by repulsive force of the foamed elastic layer 113 because of the softness of the PFA tube, and thus it is difficult to allow the foamed elastic layer to contain bubbles having a shape crushed in the thickness direction.

On the other hand, the surface resin layer 114 of the exemplary embodiment contains polyimide or polyamide-imide and thus has high strength, and elongation of the surface resin layer 114 is suppressed even by being subjected to the repulsive force of the foamed elastic layer 113. Therefore, the bubbles contained in the central portion of the foamed elastic layer 113 in the axial direction may be maintained in a shape crushed in the thickness direction.

The resin material contained in the surface resin layer 113 is particularly preferably polyimide from the viewpoint of strength, heat resistance, and dimensional stability.

The surface resin layer 114 may contain a resin other than polyimide or polyamide-imide, but polyimide or polyamide-imide is preferably contained at a highest content among the resins contained in the surface resin layer 114, and the content of polyimide or polyamide-imide is more preferably 50% by mass or more.

The thickness of the surface resin layer 114 is, for example, in a range of 0.02 mm or more and 0.2 mm or less and preferably a range of 0.02 mm or more and 0.1 mm or less. The surface resin layer 114 having a thickness of 0.02 mm or more little causes breakage or the like even when being subjected to repulsive force of the foamed resin layer 113 on the inner side, and the occurrence of turn-up is suppressed during surface cleaning with a metal blade. The thickness of the surface resin layer 114 is measured by using an eddy current thickness meter (MP30 manufactured by Fischer Inc.).

The surface resin layer 114 may contain a conductive agent.

The conductive agent contained in the surface resin layer 114 may be an electron conductive agent or an ion conductive agent.

Examples of the electron conductive agent include powders of: carbon black such as Ketjen black, and acetylene black; pyrolytic carbon, and graphite; various conductive metals or alloys such as aluminum, copper, nickel, and stainless steel; various conductive metal oxides such as tin oxide, indium oxide, titanium oxide, tin oxide-antimony oxide solid solution, and tin oxide-indium oxide solid solution; insulating materials with surfaces subjected to conductive treatment; and the like.

Specific examples of the carbon black include "Special Black 350", "Special Black 100", "Special Black 250", "Special Black 5", "Special Black 4", "Special Black 4A", "Special Black 550", "Special Black 6", "Colour Black Fw200", "Colour Black FW2", and "Colour Black FW2V" which are manufactured by Orion Engineered Carbons Co., Ltd., "MONARCH 1000", "MONARCH 1300", "MONARCH 1400", "MOGUL-L", and "REGAL 400R" which are manufactured by Cabot Corporation, and the like.

These electron conductive agents may be used alone or in combination of two or more.

Examples of the ion conductive agent include quaternary ammonium salts (for example, perchlorates, chlorates, tetrafluoroborates, sulfates, ethosulfates, halogenated benzyl salts (for example, benzyl bromide salt, benzyl chloride salt, and the like) of, lauryltrimethyl ammonium, stearyltrimethyl ammonium, octadodecyltrimethyl ammonium, dodecyltrimethyl ammonium, hexadecyltrimethyl ammonium, modified fatty acid-dimethylethyl ammonium, or the like), aliphatic sulfonic acid salts, higher alcohol sulfuric acid ester salts, higher alcohol ethylene oxide-added sulfuric acid ester salts, higher alcohol phosphoric acid ester salts, higher alcohol ethylene oxide-added phosphoric acid ester salts, betaines, higher alcohol ethylene oxides, polyethylene glycol fatty acid esters, polyhydric alcohol fatty acid esters, and the like.

These ion conductive agents may be used alone or in combination of two or more.

For example, a surface resin layer containing polyimide as a principal component (the term "principal component" represents that the content of polyimide in the surface resin layer exceeds 50% by mass) and conductive particles of carbon black dispersed as the conductive agent is used as the surface resin layer 114 because of mechanical strength and excellent elastic modulus.

(Method for Producing Transfer Roller)

Next, a method for producing the transfer roller 111 according to the exemplary embodiment is described.

A method for producing the transfer roller according to the exemplary embodiment is not particularly limited and, for example, the foamed elastic layer is formed by a method including putting, into an extruder, a rubber composition containing an elastic material, a foaming agent, and if required, further additives such as a conductive agent, extrusion-molding a cylindrical rubber composition layer on the outer peripheral surface of a cylindrical or columnar core (support), and vulcanizing and foaming the layer by heating to form the foamed elastic layer.

On the other hand, the surface resin layer may be formed by, for example, a method of applying a coating solution containing polyimide or polyamide-imide on the cylindrical core. An example of the coating method is a spiral coating method.

The transfer roller is produced by coating, with the surface resin layer (resin tube), the foamed elastic layer formed on the outer peripheral surface of the support. In producing the transfer roller by this method, in the exemplary embodiment, each of the foamed elastic layer and the surface resin layer is formed, and the foamed elastic layer is coated and tightened with the surface resin layer so that the bubbles contained in the central portion of the foamed elastic layer in the roller axial direction have a shape crushed in the thickness direction of the foamed elastic layer as compared with the bubbles contained at both ends. When the foamed elastic layer is coated with the surface resin layer, the surface resin layer is subjected to repulsive force from the foamed elastic layer, but the surface resin layer is little elongated even by being subjected to repulsive force from the foamed elastic layer because the surface resin layer contains polyimide or polyamide-imide. Therefore, the bubbles contained in the central portion of the foamed elastic layer in the roller axial direction may be maintained in a shape crushed in the thickness direction.

The outer peripheral shape of the foamed elastic layer may be a shape (straight shape) in which the diameter is uniform in the roller axial direction or a shape (crown shape) in which the diameter of the central portion in the roller axial direction is larger than that at both ends in the roller axial direction. From the viewpoint of enhancing uniformity of a nip load in the roller axial direction, the outer peripheral shape of the foamed elastic layer is the crown shape.

The outer peripheral shape of the foamed elastic layer may be formed in the straight shape or crown shape by vulcanizing and foaming the rubber composition layer formed on the outer peripheral surface of the core and then polishing the rubber composition layer with sand paper or the like.

On the other hand, the outer peripheral shape of the surface resin layer may be a shape (straight shape) in which the diameter is uniform in the roller axial direction or a shape (flare shape) in which the outer diameter of the central portion in the roller axial direction is smaller than that at both ends in the roller axial direction. From the viewpoint of enhancing uniformity of a nip load in the roller axial direction, the outer peripheral shape of the surface resin layer is the flare shape.

Examples of a combination of the shape of the foamed elastic layer and the shape of the surface resin layer include three patterns (A) to (C) below.

Figure 3:
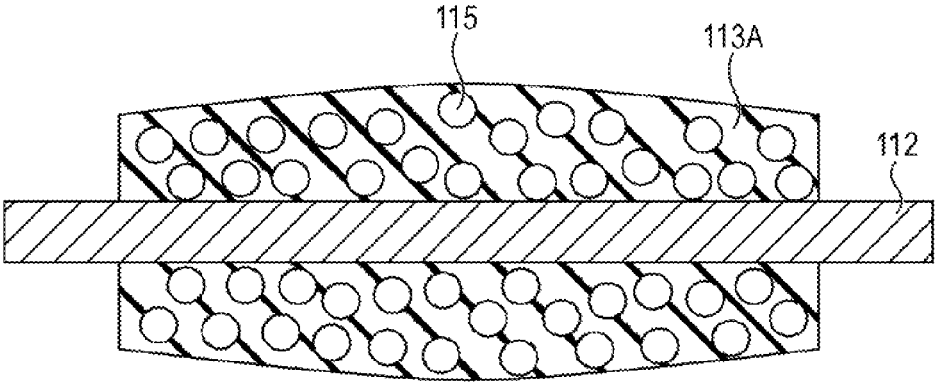
FIG. 3 is a drawing schematically showing a section in the axial direction of an example of a foamed elastic layer before coating with a surface resin layer in producing the transfer roller shown in FIG. 2.

(A) Combination of Crown-Shaped Foamed Elastic Layer and Straight-Shaped Surface Resin Layer As shown in FIG. 3, a crown-shaped foamed elastic layer 113A is formed on the outer peripheral surface of a support 112. A method for forming the crown-shaped foamed elastic layer 113A on the outer peripheral surface of the support 112 is not particularly limited. For example, the foamed elastic layer may be formed in the crown shape by forming the straight-shaped foamed elastic layer on the outer peripheral surface of the support 112 and then polishing the outer peripheral surface with sand paper or the like.

Figure 4:
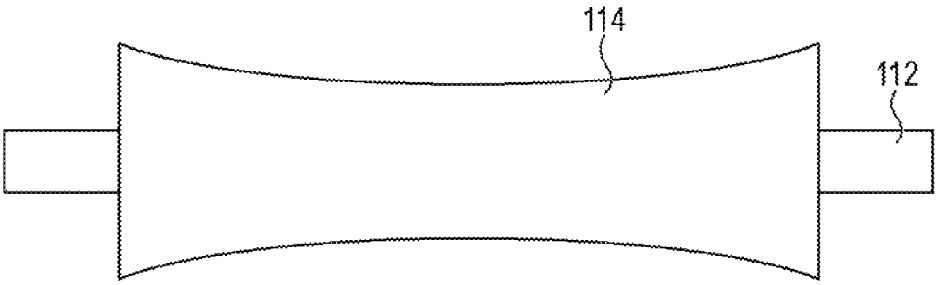
FIG. 4 is a drawing schematically showing the outer peripheral shape of the transfer roller shown in FIG. 1 in a nip part.

Next, the outer peripheral surface of the crown-shaped foamed elastic layer 113A is coated with a straight-shaped surface resin layer (resin tube) containing polyimide or polyamide-imide. As a result, the foamed elastic layer 113 is more strongly pressed in the thickness direction in the central portion than at both ends in the roller axial direction, and thus as shown in FIG. 2, the bubbles 115B in the central portion in the roller axial direction have a shape crushed in the thickness direction of the foamed elastic layer 113 as compared with the bubbles 115A at both ends in the roller axial direction. In this case, the transfer roller 111 has a straight outer peripheral shape as shown in FIG. 2. However, when in a nip part, a load is applied to the opposite member from both ends of the support 112, the transfer roller 111 has a flare shape as shown in FIG. 4 because of the small repulsive force at both ends of the foamed elastic layer 113.

(B) Combination of Crown-Shaped Foamed Elastic Layer and Flare-Shaped Surface Resin Layer.

Figure 5:
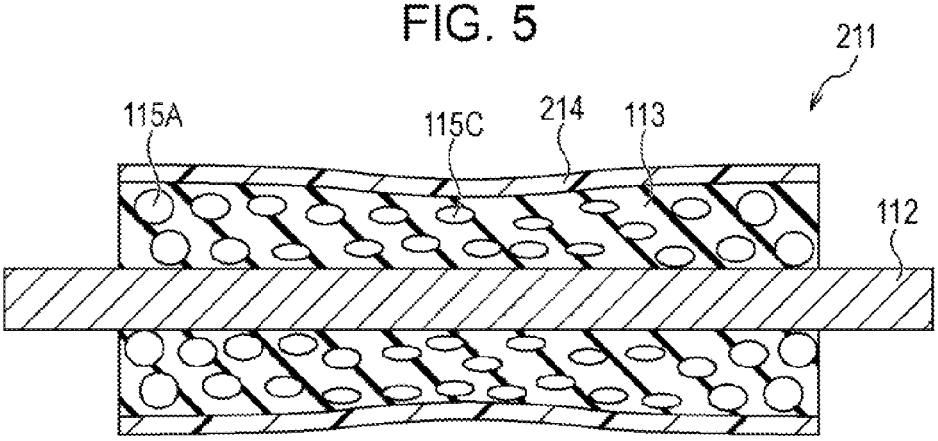
FIG. 5 is a drawing schematically showing a section in the axial direction of another example of a transfer roller according to an exemplary embodiment of the present invention.

FIG. 5 schematically shows a section in the roller axial direction of a transfer roller 211 produced by coating the outer peripheral surface of the crown-shaped foamed elastic layer 113A shown in FIG. 3 with a flare-shaped surface resin layer 214. The outer peripheral surface of the crown-shaped foamed elastic layer 113A shown in FIG. 3 is coated with the flare-shaped surface resin layer (resin tube) 214 containing polyimide or polyamide-imide. As a result, the foamed elastic layer 113 is more strongly pressed in the thickness direction in the central portion than at both ends in the roller axial direction. Therefore, bubbles 115C in the central portion in the roller axial direction are more pressed to have a shape crushed in the thickness direction of the foamed elastic layer 113 as compared with bubbles 115A at both ends in the roller axial direction. In this case, the transfer roller 211 has a flare-shaped outer peripheral surface, and in a nip part, like the transfer roller 111 shown in FIG. 2, the transfer roller 211 has a flare shape as shown in FIG. 4 because of the small repulsive force at both ends of the foamed elastic layer 113.

A method for forming the flare-shaped surface resin layer (resin tube) containing polyimide or polyamide-imide is not particularly limited. For example, two types of polyimide precursor solutions having different shrinkage rates at firing are prepared. First, a first polyimide precursor solution having a smaller shrinkage rate at firing is applied to the outer peripheral surface of a cylindrical mold and then dried and fired to form a first polyimide layer. Then, a second polyimide precursor solution having a larger shrinkage rate at firing is applied to the first polyimide layer and then dried and fired to form a second polyimide layer. The shrinkage rate on the outer peripheral side is higher than on the inner peripheral side, and thus a flare-shaped polyimide tube may be formed, in which the outer diameter (circumferential length) at both ends is larger than that in the central portion in the width direction (roller axial direction).

Also, a flare-shaped tube may be formed by applying a polyimide precursor solution or polyamide-imide solution to a mold having a flare-shaped outer peripheral surface and then curing the resultant coating film.

Figure 6:
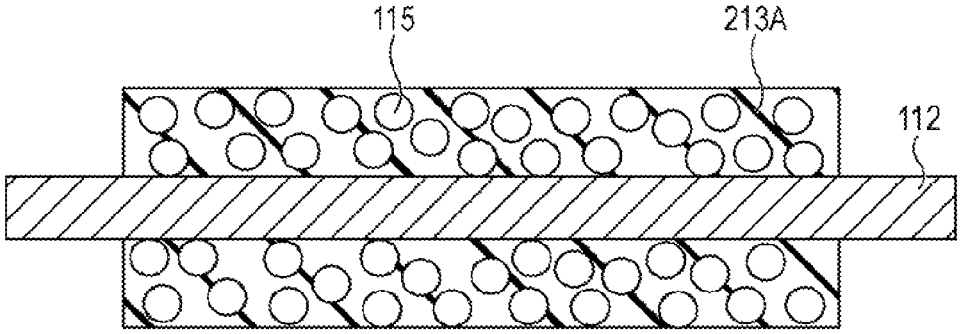
FIG. 6 is a drawing schematically showing a section in the axial direction of another example of a foamed elastic layer before coating with a surface resin layer in producing a transfer roller according to an exemplary embodiment of the present invention.
Figure 7:
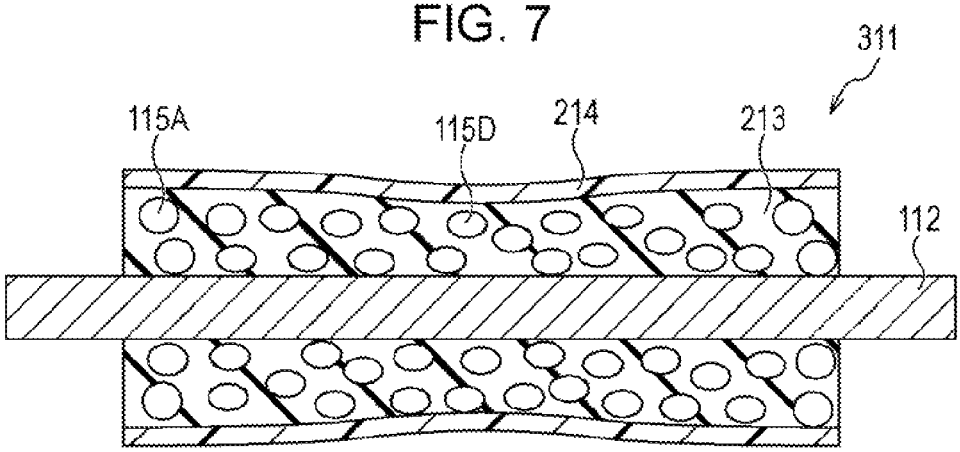
FIG. 7 is a drawing schematically showing a section in the axial direction of a further of example of a transfer roller according to an exemplary embodiment of the present invention.

(C) Combination of Straight-Shaped Foamed Elastic Layer and Flare-Shaped Surface Resin Layer A transfer roller may be produced by coating the outer peripheral surface of a straight-shaped foamed elastic layer with a flare-shape surface resin layer. As shown in FIG. 6, a straight-shaped foamed elastic layer 213A is formed on the outer peripheral surface of a support, and the outer peripheral surface of the straight-shaped foamed elastic layer 213A is coated with the flare-shaped surface resin layer (resin tube) 214 containing polyimide or polyamide-imide as shown in FIG. 7. As a result, the foamed elastic layer 213 is more strongly pressed in the thickness direction in the central portion than at both ends in the roller axial direction. Therefore, in the transfer roller 311 produced as described above, bubbles 115D in the central portion in the roller axial direction have a shape crushed in the thickness direction of the foamed elastic layer 213 as compared with bubbles 115A at both ends in the roller axial direction. In this case, the transfer roller 311 has a flare outer peripheral shape, but the bubbles 115D in the central portion in the roller axial direction are less crushed in the thickness direction than the bubbles 115C in the central portion of the flare-shaped transfer roller 211 shown in FIG. 5. Therefore, in a nip part, the transfer roller 311 has a flare shape in which the central portion is more pressed as shown in FIG. 8.

Regardless of which of the patterns (A) to (C) is used for producing the transfer roller according to the exemplary embodiment, the foamed elastic layer having a bubble density distribution in the axial direction of the support 112 may not be previously formed. The transfer roller according to the exemplary embodiment may be relatively easily produced after the foamed elastic layer 113A or 213A having a uniform bubble distribution in the axial direction is formed.

Figure 8:
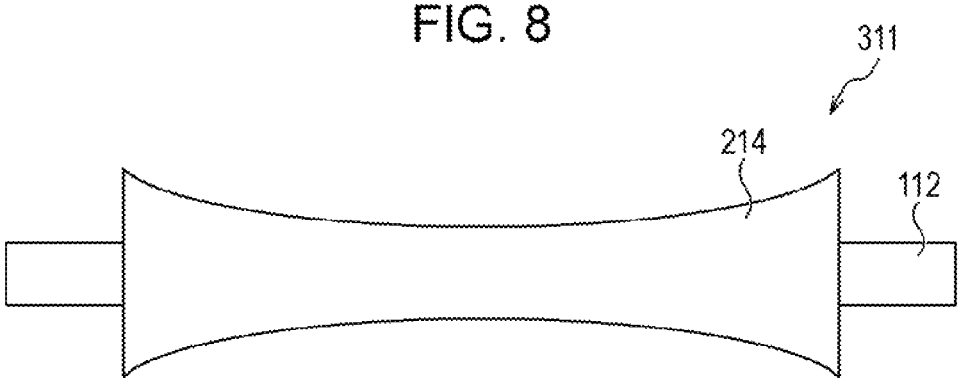
FIG. 8 is a drawing schematically showing the outer peripheral shape of the transfer roller shown in FIG. 7 in a nip part.

When the transfer roller according to the exemplary embodiment is produced in any one of the patterns (A) to (C), the shape in the nip part is a flare shape as shown in FIG. 4 or 8, and a nip load with high uniformity in the roller axial direction may be achieved. From the viewpoint of enhancing the uniformity of the nip load, the combination (A) of the crown-shaped foamed elastic layer and the straight-shaped surface resin layer (FIG. 2) or the composition (B) of the crown-shaped foamed elastic layer and the flare-shaped surface resin layer (FIG. 5) is desired for realizing the flare shape shown in FIG. 8 in the nip part.

On the other hand, when the outer diameter (circumferential length) at both ends of the transfer roller is larger than that of the central portion in the roller axial direction, the peripheral speed at both ends is higher than that in the central portion, and thus the occurrence of wrinkles of a recording medium such as paper or the like may be suppressed during transfer. Therefore, from the viewpoint of suppressing the occurrence of wrinkles in the recording medium during transfer, the transfer roller desirably has a flare-shaped outer peripheral surface, that is, the combination (B) of the crown-shaped foamed elastic layer and the flare-shaped surface resin layer (FIG. 5) or the composition (C) of the straight-shaped foamed elastic layer and the flare-shaped surface resin layer (FIG. 7).

In addition, the transfer roller 111 according to the exemplary embodiment is not limited to the configuration described above. For example, the transfer roller 111 may have a configuration in which the configuration of the transfer roller 111 shown in FIG. 1 further includes an intermediate layer such as an adhesive layer provided between the support 112 and the foamed elastic layer 113 or between the foamed elastic layer 113 and the surface resin layer 114. Also, the transfer roller 111 may have a configuration in which a resistance adjusting layer or transfer preventing layer is provided between the foamed elastic layer 113 and the surface resin layer 114.

<Image Forming Apparatus and Process Cartridge>

An image forming apparatus according to an exemplary embodiment of the present invention is an image forming apparatus including a transfer roller, and the transfer roller of the exemplary embodiment described above is applied as the transfer toll.

Specifically, the image forming apparatus according to the exemplary embodiment includes, for example, an image holding member, a charging unit that changes the image holding member, a latent image forming unit that forms a latent image on the surface of the charged image holding member, a developing unit that develops that latent image formed on the surface of the image holding member with a toner to form a toner image, and a transfer unit that includes the transfer roller according to the exemplary embodiment described above and transfers the toner image formed on the image holding member to a recording medium.

The transfer unit has, for example, a direct transfer-systemconfiguration in which the transfer roller is singly provided for transferring to the recording medium or an intermediate transfer-system configuration including an intermediate transfer body to which the toner image formed on the surface of the image holding member is transferred, a first transfer roller that transfers the toner image formed on the surface of the image holding member to the surface of the intermediate transfer body, and a second transfer roller that transfers the toner image transferred to the intermediate transfer body to the recording medium.

The direct transfer-system configuration includes the transfer roller according to the exemplary embodiment provided as the transfer roller disposed opposite to the image holding member.

The intermediate transfer-system configuration includes the transfer roller according to the exemplary embodiment provided as at least one of the first transfer roller and the second transfer roller.

The image forming apparatus according to the exemplary embodiment may be, for example, any one of a usual monocolor contains only a toner of single color, an image forming apparatus in which a toner image held on an image holding member is transferred directly to a recording medium, a color image forming apparatus in which first transfer of a toner image held on an image holding member to an intermediate transfer body sequentially repeated, and a tandem-type color image forming apparatus including respective color developing devices and plural image holding members disposed in series on an intermediate transfer body.

A process cartridge according to an exemplary embodiment includes a transfer unit that includes the transfer roller according to the exemplary embodiment described above and transfers a toner image formed on an image holding member to a recording medium, and is configured to be detachable from an image forming apparatus. As occasion demands, the process cartridge according to the exemplary embodiment may include at least one unit selected from an image holding member, a charging unit that charges the image holding member, a latent image forming unit that forms a latent image on the surface of the charged image holding member, and a developing unit that develops the latent image formed on the image holding member with a toner to form a toner image.

Figure 9:
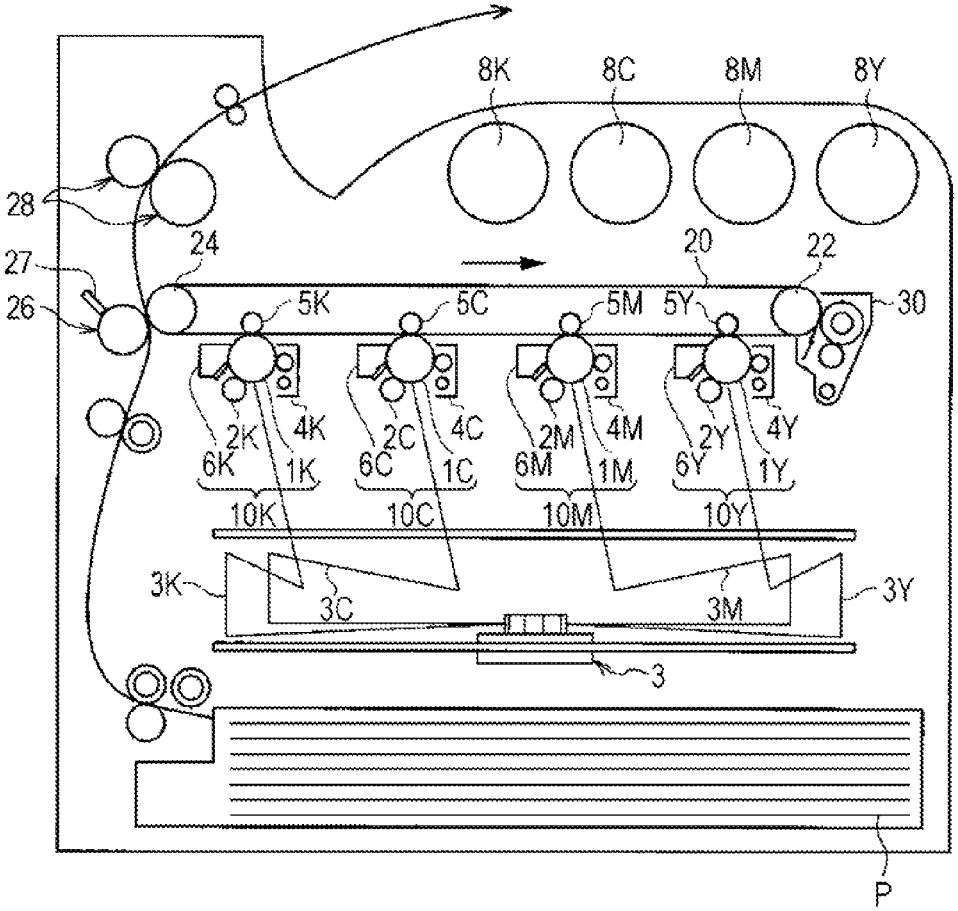
FIG. 9 is a schematic configuration drawing showing an example of an image forming apparatus according an exemplary embodiment of the present invention.

The image forming apparatus according to the exemplary embodiment is described below with reference to the drawing. FIG. 9 is a schematic configuration diagram showing the image forming apparatus according to the exemplary embodiment.

The image forming apparatus shown in FIG. 9 includes first to fourth electrophotographic image forming units 10Y, 10M, 10C, and 10K that output images of respective colors of yellow (Y), magenta (M), cyan (C), and black (K) on the basis of image data obtained by color separation. The image forming units (simply referred to as "units" hereinafter) 10Y, 10M, 10C, and 10K are disposed in parallel at specific distances therebetween in a horizontal direction. The units 10Y, 10M, 10C, and 10K may be process cartridges datable from the body of the image forming apparatus.

An intermediate transfer belt 20 is disposed as an intermediate transfer body above the units 10Y, 10M, 10C, and 10K as shown in the drawing so as to pass through the units. The intermediate transfer belt 20 is wound so as to move in a direction from the first unit 10Y to the fourth unit 10K by applying tension to a driving roll 22 and a support roll 24 in contact with the inner side of the intermediate transfer belt 20 which are disposed at a distance therebetween in the lateral direction of the drawing, thereby constituting a transfer unit for the image forming apparatus.

The support roll 24 is urged by a spring or the like (not shown) in a direction away from the driving roll 22, and specific tension is applied to the intermediate transfer belt 20 wound around both rolls. Also, an intermediate transfer body cleaning device 30 is provided on the image holding side of the intermediate transfer belt 20 so as to face the driving roll 22.

In addition, four color toners of yellow, magenta, cyan, and black contained in toner cartridges 8Y, 8M, 8C, and 8K, respectively, may be supplied to developing devices (developing units) 4Y, 4M, 4C, and 4K of the units 10Y, 10M, 10C, and 10K, respectively.

The first to fourth units 10Y, 10M, 10C, and 10K described above have the same configuration, and thus the first unit 10Y that forms a yellow image and is disposed on the upstream side in the traveling direction of the intermediate transfer belt is described as a representative. The description of the second to fourth units 10M, 10C, and 10K is omitted by adding reference numerals with magenta (M), cyan (C), and black (K) in place of yellow (Y) to portions equivalent to those of the first unit 10Y.

The first unit 10Y includes a photoconductor 1Y functioning as an image holding member. Around the photoconductor 1Y, there are sequentially provided a charging roller 2Y that charges the surface of the photoconductor 1Y to a specific potential, an exposure device 3 that forms an electrostatic image by exposure of the charged surface to a laser beam 3Y based on an image signal obtained by color separation, a developing device (developing unit) 4Y that develops the electrostatic image by supplying a charged toner to the electrostatic image, a first transfer roller 5Y (first transfer unit) that transfers the developed toner image to the intermediate transfer belt 20, and a photoconductor cleaning device (cleaning unit) 6Y that removes the toner remaining on the surface of the photoconductor 1Y by a cleaning blade after first transfer.

The first transfer roller 5Y is disposed on the inside of the intermediate transfer belt 20 and is provided at a position opposite to the photoconductor 1Y. Further, a bias power supply (not shown) is connected to each of the first transfer rollers 5Y, 5M, 5C, and 5K in order to apply a first transfer bias thereto. The transfer bias applied to each of the first transfer rollers from the bias power supply may be changed by a controller (not shown).

An operation of forming a yellow image in the first unit 10Y is described below. First, before the operation, the surface of the photoconductor 1Y is charged to a potential of about −600 V or more and −800 V or less by the charging roller 2Y.

The photoconductor 1Y is formed by laminating a photosensitive layer on a substrate having conductivity (volume resistivity at 20° C.: $1\times10^6$ Ωcm or less). The photosensitive layer generally has high resistance (equivalent to the resistance of general resins) and has the property of being changed in resistivity in a portion irradiated with a laser beam 3Y when being irradiated with the laser beam 3Y. Therefore, the laser beam 3Y is output to the surface of the charged photoconductor 1Y through the exposure device 3 according to yellow image data sent from the controller (not shown). The photosensitive layer on the surface of the photoconductor 1Y is irradiated with the laser beam 3Y, thereby forming an electrostatic image in a yellow print pattern on the surface of the photoconductor 1Y.

The electrostatic image is an image formed on the surface of the photoconductor 1Y by charging and is a so-called negative latent image formed by the charge flowing on the surface of the photoconductor 1Y due to decrease in resistivity of an irradiated portion of the photosensitive layer irradiated with the laser beam 3Y and the charge remaining in a portion not irradiated with the laser beam 3Y.

The electrostatic image formed on the photoconductor 1Y as described above is rotated to a specific development position with travel of the photoconductor 1Y. Then, at the development position, the electrostatic image on the photoconductor 1Y is visualized to an image (developed image) by the developing device 4Y.

The developing device 4Y contains, for example, yellow toner. The yellow toner is triboelectrically charged by stirring in the developing device 4Y to have charge with the same polarity (negative polarity) as the charge on the photoconductor 1Y and is held on a developer roller (developer holding member). When the surface of the photoconductor 1Y is passed through the developing device 4Y, the yellow toner electrostatically adheres to an electrostatically removed latent image portion on the surface of the photoconductor 1Y to develop the latent image with the yellow toner. Then, the photoconductor 1Y on which the yellow toner image has been formed is continuously traveled at a specific speed, and the toner image developed on the photoconductor 1Y is conveyed to a specific first transfer position.

When the yellow toner image on the photoconductor 1Y is conveyed to the first transfer part, the specific first transfer bias is applied to the first transfer roller 5Y, and electrostatic force to the first transfer roller 5Y from the photoconductor 1Y is applied to the toner image, thereby transferring the toner image on the photoconductor 1Y to the intermediate transfer belt 20. The applied transfer bias has (+) polarity opposite to (−) polarity of the toner and, for example, in the first unit 10Y, the bias is controlled to about +10 μA by the controller (not shown).

On the other hand, the toner remaining on the photoconductor 1Y is removed by the cleaning device 6Y and recovered.

Also, the first transfer bias applied to each of the first transfer rollers 5M, 5C, and 5K of the second unit 10M and latter units is controlled according to the first unit 10Y.

Then, the intermediate transfer belt 20 to which the yellow toner image has been transferred the first unit 10Y is sequentially conveyed through the second to fourth units 10M, 10C, and 10K to superpose the toner images of the respective colors by multi-layer transfer.

The intermediate transfer belt 20 to which the four color toner images have been transferred in multiple layers through the first to fourth units is reached to a second transfer part including the intermediate transfer belt 20, the support roll 24 in contact with the inner side of the intermediate transfer belt 20, and the second transfer roller (second transfer unit) 26 disposed on the image holding surface side of the intermediate transfer belt 20. In addition, a cleaning blade 27 made of an elastic material is in contact with the outer peripheral surface of the second transfer roller 26 in order to remove the toner remaining untransferred to recording medium P from the intermediate transfer belt 20 and adhering to the outer peripheral surface of the second transfer roller 26.

On the other hand, the recording medium P is fed with specific timing, through a feeding mechanism, to a space in which the second transfer roller 26 is in contact with the intermediate transfer belt 20 and a specific second transfer bias is applied to the support roll 24. The applied transfer bias has the same polarity (−) as the polarity (−) of the toner and electrostatic force acting toward the recording medium P from the intermediate transfer belt 20 is applied to the toner image to transfer the toner image on the intermediate transfer belt 20 to the recording medium P. The second transfer bias is determined according to the resistance detected by a resistance detector (not shown) that detects the resistance of the second transfer part, and the voltage is controlled.

Then, the recording medium P is sent to a fixing device (fixing unit) 28 in which the superposed color toner images are melted by heating and fixed to the recording medium P. The recording medium P after the completion of fixing of the color image is conveyed to a discharge part, and a series of color image forming operations is finished.

The image forming apparatus described as an example is configured to transfer the toner image to the recording medium P through the intermediate transfer belt 20. However, the image forming apparatus according to the exemplary embodiment is not limited to the configuration described above and may have a structure in which the toner image is transferred directly to the recording medium P from the photoconductor.

EXAMPLES

The present invention is described in detail below by giving examples, but the present invention is not limited to these examples. In description below, "parts" is on a mass basis unless otherwise particularly specified.

Example 1

<Crown-Shaped Foamed Elastic Layer and Straight-Shaped Polyimide Tube>

(Formation of Foamed Elastic Layer)

A urethane layer formed by polymerizing isocyanate and polyol is molded into a roll shape on a metal shaft of 12 mm in diameter used for an ion conductive roller and then vulcanized and foamed by heating to form a foamed urethane layer of 22 mm in diameter. In this case, benzenesulfonyl hydrazide is used as a foaming agent. Then, the outer peripheral surface of the foamed urethane layer is polished to form a foamed elastic layer (axial-direction length: 210 mm) having a crown shape in which the outer diameter at both ends is 20 mm and the outer diameter of a central portion is 100 μm larger than that at both ends.

(Formation of Polyimide Tube)

Carbon black serving as a conductive agent in an amount of 25 parts by mass based on 100 parts by mass of a resin component is added to a solvent-soluble polyimide resin, Vylomax HR16NN (solid content: 18% by mass, solvent: methyl-2-pyrrolidone) manufactured by Toyobo Co., Ltd., used as a polyimide resin for forming a surface resin layer, and then dispersed by using a disperser to prepare a coating solution. The coating solution is applied to the outer surface of an aluminum pipe having an outer diameter of 20 mm and dried and fired to form a straight-shaped polyimide tube (diameter: 20 mm) having a thickness of 100 μm.

Then, the foamed elastic layer formed on the metal shaft is inserted into the polyimide tube formed as described above. As a result, a transfer roller having a two-layer structure in which the outer peripheral surface of to crown-shaped foamed elastic layer is coated with the straight-shaped polyimide tube (surface resin layer) is produced.

Example 2

<Crown-Shaped Foamed Elastic Layer and Flare-Shaped Polyimide Tube>

(Formation of Foamed Elastic Layer)

A urethane layer formed by polymerizing isocyanate and polyol is molded into a roll shape on a metal shaft of 12 mm in dimeter used for an ion conductive roller and then vulcanized and foamed by heating to form a foamed urethane layer of 22 mm in diameter. Then, the outer peripheral surface of the foamed urethane layer is polished to form a foamed elastic layer (axial-direction length: 210 mm) having a crown shape in which the outer diameter at both ends is 20 mm and the outer diameter of a central portion is 100 μm larger than that at both ends.

(Formation of Polyimide Tube)

Carbon black serving as a conductive agent in an amount of 25 parts by mass based on 100 parts by mass of a resin component is added to a solvent-soluble polyimide resin, Vylomax HR16NN (solid content: 18% by mass, solvent: methyl-2-pyrrolidone) manufactured by Toyobo Co., Ltd., used as a polyimide resin for forming a surface resin layer, and then dispersed by using a disperser to prepare a coating solution 1.

Also, PTFE (polytetrafluoroethylene, solid content: 5% by mass) is added to a material containing the same components as in the coating solution 1 and is then dispersed to prepare a coating solution 2.

The coating solution 1 is applied to the outer surface of an aluminum pipe having an outer diameter of 20 mm and dried and fired to form a layer having a thickness of 50 μm. Then, similarly, the coating solution 2 is applied to the resultant layer and dried and fired to form a polyimide tube (outer diameter at both ends: 20 mm) having a total thickness of 100 μm. The resultant polyimide tube has a shape (flare shape) in which the outer diameter of a central portion in the roller axial direction is 300 μm smaller than that at both ends in the roller axial direction.

Then, the foamed elastic layer formed on the metal shaft is inserted into the polyimide tube formed as described above. As a result, a transfer roller having a two-layer structure in which the outer peripheral surface of the crown-shaped foamed elastic layer is coated with the flare-shaped polyimide tube (surface resin layer) is produced.

Example 3

<Straight-Shaped Foamed Elastic Layer and Flared-Shaped Polyimide Tube>

(Formation of Foamed Elastic Layer)

A urethane layer formed by polymerizing isocyanate and polyol is molded into a roll shape on a metal shaft of 12 mm in diameter used for an ion conductive roller and then vulcanized and foamed by heating to form a foamed urethane layer of 22 mm in diameter. Then, the outer peripheral surface of the foamed urethane layer is polished to form a foamed elastic layer (axial-direction length: 210 mm) having a straight shape with an outer diameter of 20 mm.

(Formation of Polyimide Tube)

Carbon black serving as a conductive agent in an amount of 25 parts by mass based on 100 parts by mass of a resin component is added to a solvent-soluble polyimide resin, Vylomax HR16NN (solid content: 18% by mass, solvent: methyl -2-pyrrolidone) manufactured by Toyobo Co., Ltd., used as a polyimide resin for forming a surface resin layer, and then dispersed by using a disperser to prepare a coating solution 1.

Also, PTFE (solid content: 5% by mass) is added to a material containing the same components as in the coating solution 1 and is then dispersed to prepare a coating solution 2.

The coating solution 1 is applied to the outer surface of an aluminum pipe having an outer diameter of 20 mm and dried and fired to form a layer having a thickness of 50 μm. Then, similarly, the coating solution 2 is applied to the resultant layer and dried and fired to form a polyimide tube (outer diameter at both ends: 20 mm) having a total thickness of 100 μm. The resultant polyimide tube has a shape (flare shape) in which the outer diameter of a central portion in the roller axial direction is 300 μm smaller than that at both ends in the roller axial direction.

Then, the foamed elastic layer formed on the metal shaft is inserted into the polyimide tube formed as described above. As a result, a transfer roller having a two-layer structure in which the outer peripheral surface of the straight-shaped foamed elastic layer is coated with the flare-shaped polyimide tube (surface resin layer) is produced.

Comparative Example 1

<Straight-Shaped Foamed Elastic Layer and Straight-Shaped Polyimide Tube>

(Formation of Foamed Elastic Layer)

A urethane layer formed by polymerizing isocyanate and polyol is molded into a roll shape on a metal shaft of 12 mm in diameter used for an ion conductive roller and then vulcanized and foamed to form a foamed urethane layer of 22 mm in diameter. Then, the outer peripheral surface of the foamed urethane layer is polished to form a foamed elastic layer having a straight shape with an outer diameter of 20 mm.

(Formation of Polyimide Tube)

Carbon black serving as a conductive agent in an amount of 25 parts by mass based on 100 parts by mass of a resin component is added to a solvent-soluble polyimide resin, Vylomax HR16NN (solid content: 18% by mass, solvent: methyl-2-pyrrolidone) manufactured by Toyobo Co., Ltd., used as a polyimide resin for forming a surface resin layer, and then dispersed by using a disperser to prepare a coating solution.

The coating solution is applied to the outer surface of an aluminum pipe having an outer diameter of 20 mm and dried and fired to form a polyimide tube (diameter of 20 mm) having a straight shape with a thickness of 100 μm.

Then, the foamed elastic layer formed on the metal shaft is inserted into the polyimide tube formed as described above. As a result, a transfer roller having a two-layer structure in which the outer peripheral surface of the straight-shaped foamed elastic layer is coated with the straight-shaped polyimide tube (surface resin layer) is produced.

Reference Example 1

A urethane layer formed by polymerizing isocyanate and polyol is molded into a roll shape on a metal shaft of 12 mm in diameter used for an ion conductive roller and then vulcanized and foamed to form a foamed urethane layer of 22 mm in diameter. Then, the outer peripheral surface of the foamed urethane layer is polished to form a foamed elastic layer having a crown shape in which the outer diameter at both ends is 20 mm and the outer diameter of a central portion is 100 μm larger than that at both ends.

[Evaluation]

The transfer roller produced in each of the examples is provided as a second transfer roller in a modified machine of an image forming apparatus, DocuCentre-II C6500 manufactured by Fuji Xerox Co., Ltd.

By using the image forming apparatus, image quality and paper back staining are evaluated in an initial stage and after printing on 3,000,000 sheets at room temperature.

<Transfer Unevenness>

The transfer roller produced in each of the examples is provided as a second transfer roller in a modified machine of an image forming apparatus, DocuCentre-II C6500 manufactured by Fuji Xerox Co., Ltd.

By using the image forming apparatus, an image is printed at a K-color density of 30% on A4-size paper used as a recording medium, and density unevenness in the roller axial direction is evaluated. The density unevenness is confirmed by visual sensory evaluation of the 10-th image (initial image) and 3000000-th image (image over time) and is evaluated according to criteria below.

A: No density unevenness is observed in the roller axial direction.

B: Slight density unevenness occurs but is hardly confirmable by visual observation.

C: Density unevenness occurs at a level confirmable by visual observation.

<Paper Wrinkles>

The occurrence of paper wrinkles is evaluated for 10 sheets of paper each in the initial state and after the elapse of time in the printing described above (initial stage: 1st to 10th sheets of paper, elapse of time: 2999990-th to 3000000-th sheets of paper).

A: Occurrence of no paper wrinkles

B: Occurrence of paper wrinkles

<Cleaning Defect>

Toner staining on the back surface of paper (paper back staining) is evaluated for the paper evaluated about the paper wrinkles described above. Evaluation criteria are as follows.

A: Substantially no toner staining occurs on the back surface of paper

B: Slight toner staining occurs on the back surface of paper but is hardly confirmable by visual observation.

C: Toner staining occurs on the back surface of paper.

<Shape of Bubbles in Foamed Elastic Layer>

After each of the evaluations described below, the transfer roller is removed from the image forming apparatus, and the foamed elastic layer is cut along the axial direction. Then, the thickness-direction length X and axial-direction length Y of each of the shapes of cavities (corresponding to bubbles) are measured by using a microscope and X/Y is determined in a portion at each of the ends (a portion having a width of 20 mm from each end (end surface) to a central portion) and in a central portion having a width of 100 mm with a middle point between both ends (end surfaces) as a center in the axial direction of the foamed elastic layer. An average value of X/Y determined for 100 cavities in each of the portions is calculated, and the shape of bubbles is evaluated.

The bubbles contained in the foamed elastic layer of the transfer roller produced in each of Examples 1 to 3 have a shape in which X/Y in the central portion is smaller than X/Y at the both ends in the axial direction, and the shape of the bubbles in the central portion is crushed in the thickness direction.

On the other hand, the bubbles contained in the foamed elastic layer of the transfer roller produced in Comparative Example 1 have a shape in which X/Y in the central portion is the same as at the both ends in the axial direction.

Table 1 shows the principal configuration and evaluation results of the foamed elastic layer and the surface resin layer (polyimide tube) of the transfer roller produced in each of the examples.

TABLE 1

| | Foamed elastic layer | | | Surface resin layer | | | Initial image quality | | | Image quality over time | | |
|---|---|---|---|---|---|---|---|---|---|---|---|---|
| | Resin component | Shape | Outer diameter of central portion - outer diameter at end (μm) | Resin component | Shape | Outer diameter at end - outer diameter of central portion (μm) | Density unevenness in axial direction | Paper wrinkle | Paper back staining | Density unevenness in axial direction | Paper wrinkle | Paper back staining |
| Example 1 | Urethane | Crown | 100 | Polyimide | Straight | 0 | A | B | A | A | B | A |
| Example 2 | Urethane | Crown | 100 | Polyimide | Flare | 300 | A | A | A | A | A | A |
| Example 3 | Urethane | Straight | 0 | Polyimide | Flare | 300 | B | A | A | B | A | A |
| Comparative Example 1 | Urethane | Straight | 0 | Polyimide | Straight | 0 | C | B | A | C | B | A |
| Reference Example 1 | Urethane | Crown | 100 | — | — | — | A | A | B | A | A | C |

Tables 1 indicates that in the examples, the occurrence of density unevenness in the axial direction is suppressed as compared with in the comparative example. Also, in Reference Example 1, the occurrence of density unevenness in the axial direction is suppressed, but the crown-shaped foamed elastic layer is not coated with the polyimide tube, and thus it is considered that the toner adhering to the outer peripheral surface of the foamed elastic layer re-adheres to the back surface of paper due to insufficient cleaning with the blade, thereby causing the occurrence of paper back staining.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer roller comprising:

a support;

a foamed elastic layer disposed on an outer peripheral surface of the support, bubbles in a central portion in a roller axial direction having a shape crushed in a thickness direction of the foamed elastic layer as compared with bubbles at both ends in the roller axial directions; and surface resin layer that covers an outer peripheral surface of the foamed elastic layer and contains polyimide or polyamide-imide.

2. The transfer roller according to claim 1, wherein an outer diameter at both ends in the roller axial direction of the surface resin layer is larger than an outer diameter in a central portion in the roller axial direction of the surface resin layer.

3. A process cartridge detachable from an image forming apparatus, the process cartridge comprising:

a transfer unit that includes the transfer roller according to claim 1 and transfers a toner image formed on the surface of an image holding member to a recording medium.

4. An image forming apparatus comprising:

an image holding member a charging unit that charges the image holding member;

a latent image forming unit that forms a latent image on a surface of the charged image holding member;

a developing unit that develops the latent image formed on the surface of the image holding member with a toner to form a toner image; and a transfer unit that includes the transfer roller according to claim 1 and transfers the toner image formed on the surface of the image holding member to a recording medium.

* * * * *